US009794702B2

(12) United States Patent
Hellmuth et al.

(10) Patent No.: US 9,794,702 B2
(45) **Date of Patent: *Oct. 17, 2017**

(54) IMPLANTABLE MICROPHONE FOR HEARING SYSTEMS

(71) Applicant: MED-EL Elektromedizinische Geraete GmbH, Innsbruck (AT)

(72) Inventors: Alexander Hellmuth, Innsbruck (AT); Thomas Zahnert, Dresden (DE); Gert Hofmann, Lange Grück (DE); Matthias Bornitz, Dresden (DE); Hannes Seidler, Dresden (DE); Karl-Bernd Hüttenbrink, Dresden (DE)

(73) Assignee: MED-EL Elektromedizinische Geraete GmbH, Innsbruck (AT)

( * ) Notice: Subject to any disclaimer, the term of this patent is extended or adjusted under 35 U.S.C. 154(b) by 800 days.

This patent is subject to a terminal disclaimer.

(21) Appl. No.: 14/103,929

(22) Filed: Dec. 12, 2013

(65) Prior Publication Data

US 2014/0100415 A1 Apr. 10, 2014

Related U.S. Application Data

(63) Continuation-in-part of application No. 12/952,934, filed on Nov. 23, 2010, now Pat. No. 8,721,518.
(Continued)

(51) Int. Cl.
*H04R 25/00* (2006.01)

(52) U.S. Cl.
CPC ..... *H04R 25/606* (2013.01)

(58) Field of Classification Search
CPC .. H04R 25/606; H04R 2225/67; H04R 19/06; H04R 7/16; H04R 7/18; H04R 7/20
See application file for complete search history.

(56) References Cited

U.S. PATENT DOCUMENTS

| | | | |
|---|---|---|---|
| 7,860,259 | B2 | 12/2010 | Onishi et al. |
| 2004/0039245 | A1 | 2/2004 | Jaeger et al. |

(Continued)

FOREIGN PATENT DOCUMENTS

| | | | |
|---|---|---|---|
| EP | 1439737 | A2 | 7/2004 |
| WO | 9931933 | A1 | 6/1999 |
| WO | 2009067616 | A1 | 5/2009 |

OTHER PUBLICATIONS

International Searching Authority—International Search Report—International Application No. PCT/US2010/057825 dated Apr. 7, 2011, together with the Written Opinion of the International Searching Authority, 8 pages.

*Primary Examiner* — Charles A Marmor, II
*Assistant Examiner* — Carrie R Dorna
(74) *Attorney, Agent, or Firm* — Sunstein Kann Murphy & Timbers LLP

(57) ABSTRACT

An implantable microphone for use in hearing systems includes a housing having a sidewall, a first membrane coupled to a top portion of the housing and configured to move in response to movement from an auditory ossicle, and a second membrane coupled to the sidewall such that an interior volume of the housing is divided into a first volume and a second volume. The first volume has an opening that permits fluid to flow out from the first volume. The implantable microphone also includes a vibration sensor coupled to the second membrane and configured to measure the movement of the second membrane and to convert the measurement into an electrical signal. The vibration sensor may include a piezoelectric sensor and/or a MEMS sensor.

27 Claims, 10 Drawing Sheets

Related U.S. Application Data

(60) Provisional application No. 61/264,139, filed on Nov. 24, 2009.

(56) References Cited

U.S. PATENT DOCUMENTS

| | | | |
|---|---|---|---|
| 2005/0113633 | A1 | 5/2005 | Blau et al. |
| 2009/0034773 | A1 | 2/2009 | Song |

Section A-A

IMPLANTABLE MICROPHONE FOR HEARING SYSTEMS

CROSS-REFERENCE TO RELATED APPLICATIONS

This patent application is a continuation-in-part of U.S. patent application Ser. No. 12/952,934 filed Nov. 23, 2010, which claims the benefit of U.S. Provisional Patent Application No. 61/264,139 filed Nov. 24, 2009, the disclosures of which are incorporated by reference herein in its entirety.

TECHNICAL FIELD

The present invention relates to implantable microphones, and more specifically to implantable microphones with vibration sensors, also regarded as force sensor, for use with cochlear implants and other hearing systems.

BACKGROUND ART

Implantable microphones for use with cochlear implants and other hearing systems typically require an implantable converter for receiving the sound reaching the ear of the patient and converting the sound into electrical signals for further processing in the hearing system. Different solutions have been proposed in the past. In one approach, the sound waves reaching the ear are directly converted into electrical signals which can be accomplished in different ways as described, for example, in U.S. Pat. Nos. 3,882,285, 4,988,333, 5,411,467, and WO 96/21333 and EP 0 831 673. However, with this approach, the natural ability of the outer ear of directionally filtering the received sound is lost and/or the attachment of the required converter components can cause adverse reactions of the affected and surrounding tissue.

In another approach, the natural sound receiving mechanisms of the human outer and middle ear are used for converting the received sound into oscillations of the middle ear components (eardrum and ear ossicle), which are subsequently converted into electrical signals. Different converter principles have been proposed. For example, U.S. Pat. No. 3,870,832 describes implantable converters based on electromagnetic principles. However, the relatively high power consumption of such electromagnetic and electrodynamic converters limits their practical application for cochlear implants and other implantable hearing systems.

This disadvantage is obviated by converters based on piezoelectric principles. EP 0 263 254 describes an implantable converter made of a piezoelectric film, a piezoelectric crystal or a piezoelectric acceleration sensor, whereby one end of the converter is cemented in the bone while the other end is fixedly connected with an oscillating member of the middle ear. The problem with this approach is that inflexible connections to the ear ossicles can cause bone erosion, so that cementing converter components in the middle ear space is approached cautiously for mechanical and toxicological reasons. Moreover, the patent reference does not indicate how the body fluids can be permanently prevented from making contact with the piezoelectric materials. Accordingly, there is a risk of biocompatibility problems, so that the piezoelectric properties can deteriorate due to physical and chemical interactions between the piezoelectric material and the body fluids.

U.S. Pat. No. 3,712,962 describes an implantable converter that uses a piezoelectric cylinder or a piezoelectric beam as a converter component that is anchored in the ear in a manner that is not described in detail. This reference, like the aforementioned patent EP 0 263 254, does not describe in detail how body fluids can be permanently prevented from making contact with the piezoelectric materials.

WO 99/08480 describes an implantable converter based on piezoelectric principles, which is attached solely to an oscillating middle ear component, with the counter support being provided by an inertial mass connected with the converter. However, the attachment of the converter to an oscillating middle ear component, such as the ear drum or the ear ossicles, is either not permanently stable or can erode the bone. This risk is aggravated because the mass of the implantable converter is greater than that of passive middle ear implants.

WO 94/17645 describes an implantable converter based on capacitive or piezoelectric principles, that can be fabricated by micromechanical techniques. This converter is intended to operate a pressure detector in the incudostapedial joint. Since the stapes in conjunction with the coupled inner ear forms a resonant system, it may not have sufficient sensitivity across the entire range of useful frequencies. This problem applies also to the implantable converters described in WO 97/18689 and DE 100 30 372 that operate by way of hydro-acoustic signal transmission.

U.S. Pat. No. 3,712,962 describes an implantable converter that uses a piezoelectric converter element that is housed in a hermetically sealed hollow body. The implantable converter is held in position by a support element affixed in the bone channel of the stapes tendon or extended from a screw connection with an ossicle of the middle ear space.

WO 97/11575 describes an implantable hearing aid having a piezo-based microactuator. It includes a disk-shaped transducer which is attached to an end of a tube. The tube is adapted to be screwed into a fenestration formed through the promontory.

U.S. Pat. No. 5,842,967 teaches an implantable contactless stimulation and sensing system utilizing a series of implantable magnets.

SUMMARY OF EMBODIMENTS

In accordance with one embodiment of the invention, an implantable microphone for use in hearing systems includes a housing having a sidewall, a first membrane coupled to a top portion of the housing and configured to move in response to movement from an auditory ossicle, and a second membrane coupled to the sidewall such that an interior volume of the housing is divided into a first volume and a second volume. The first volume has an opening that permits fluid to flow from the first volume. The implantable microphone also includes a vibration sensor coupled to the second membrane and configured to measure the movement of the second membrane and to convert the measurement into an electrical signal.

In some embodiments, the vibration sensor may be coupled to the sidewall and/or coupled to the second membrane. The vibration sensor may be a piezoelectric sensor and/or may be a MEMS differential capacitor. The piezoelectric sensor may be shaped as a rectangular bar. The opening may be in the sidewall. When the opening is in the sidewall, the fluid may be permitted to flow from the first volume to the second volume and/or to an area external to the housing. The second volume may include a second opening in a back wall and/or the sidewall. The fluid may be a gas and/or a liquid. The vibration sensor may be coupled to the second membrane with a coupling element positioned between the vibration sensor and the second membrane and configured to move the vibration sensor in response to movement from the second membrane. The housing may further include a back wall adjacent to the sidewall and having a recess configured to be coupled to the auditory ossicle. The recess may include a channel extending to the sidewall. The recess may be substantially aligned with a center of the first membrane. The implantable microphone may further include a spring element coupled to the vibration sensor and configured to contact a back wall of the housing. The implantable microphone may further include one or more additional vibration sensors adjacent to the vibration sensor and coupled to the sidewall and/or the vibration sensor. The implantable microphone may further include a spring element coupled to the one or more additional vibration sensors and configured to contact the housing and to assist in keeping the one or more vibration sensors in contact with each other and the second membrane. The vibration sensor may include a stack of vibration sensors. The first volume may be less than the second volume.

In accordance with another embodiment of the invention, an implantable microphone for use in hearing systems includes a housing having a sidewall and a back wall adjacent to the sidewall. The back wall has a recess configured to be coupled to an auditory ossicle. The implantable microphone also includes a first membrane coupled to a top portion of the housing and configured to move in response to movement from the auditory ossicle, and a second membrane coupled to the sidewall such that an interior volume of the housing is divided into a first volume and a second volume. The first volume has an opening that permits fluid to flow from the first volume. The second membrane is configured to move in response to movement from the fluid. The implantable microphone further includes a MEMS differential capacitor sensor coupled to the second membrane and configured to measure the movement of the second membrane and to convert the measurement into an electrical signal.

In some embodiments, the vibration sensor may be coupled to the second membrane with a coupling element between the second membrane and the vibration sensor and configured to assist in keeping the vibration sensor in contact with the second membrane. The coupling element may be substantially aligned with a center of the second membrane. The opening may be in the sidewall. When the opening is in the sidewall, the fluid may be permitted to flow from the first volume to the second volume and/or to an area external to the housing. The second volume may include a second opening in the back wall and/or the sidewall.

BRIEF DESCRIPTION OF THE DRAWINGS

The foregoing features of the invention will be more readily understood by reference to the following detailed description, taken with reference to the accompanying drawings, in which.

DESCRIPTION OF ILLUSTRATIVE EMBODIMENTS

Various embodiments of the present invention provide an implantable microphone for use in hearing systems, such as cochlear implant systems. The implantable microphone includes a housing and a first membrane coupled to a top portion of the housing and configured to be coupled to an auditory ossicle. The implantable microphone also includes a second membrane coupled to a sidewall of the housing and a vibration sensor coupled to the second membrane. The second membrane is configured to move in response to movement from the auditory ossicle. The second membrane is positioned within the housing in such a way that an interior volume of the housing is divided into two volumes, and one volume includes an opening that permits fluid to flow from the one volume to the other volume and/or to an exterior area outside of the housing. The vibration sensor is configured to measure the movement of the second membrane and to convert the measurement into an electrical signal. The vibration sensor may be a piezoelectric sensor or may be a microelectromechanical system (MEMS) differential capacitor.

This configuration allows the implantable microphone to reduce the mechanical stresses on the vibration sensor due to static membrane deflections of the first membrane. Static membrane deformations, which are typically larger than the membrane deformations caused by movement of the auditory ossicle, may evoke larger tensile and/or compressive stresses inside the vibration sensor that could cause its destruction. The use of an opening in one volume allows fluid to flow from one volume to the other volume and/or to an area exterior to the housing and prevents the vibration sensor from being subjected to the static membrane deflections of the first membrane, and thus protects the vibration sensor from potential harm or deterioration. The configuration also allows flexibility in the orientation of the microphone within the middle ear based on a patient's anatomical or surgical requirements. In addition, the configuration allows the placement of the microphone to be optimized on the auditory ossicle, providing an increase in the sensitivity of the device. Reducing the amount of space needed for the microphone also allows the middle ear elements to undergo less trauma, e.g., less bone or cartilage needs to be removed. Details of illustrative embodiments are discussed below.

Figure 1:
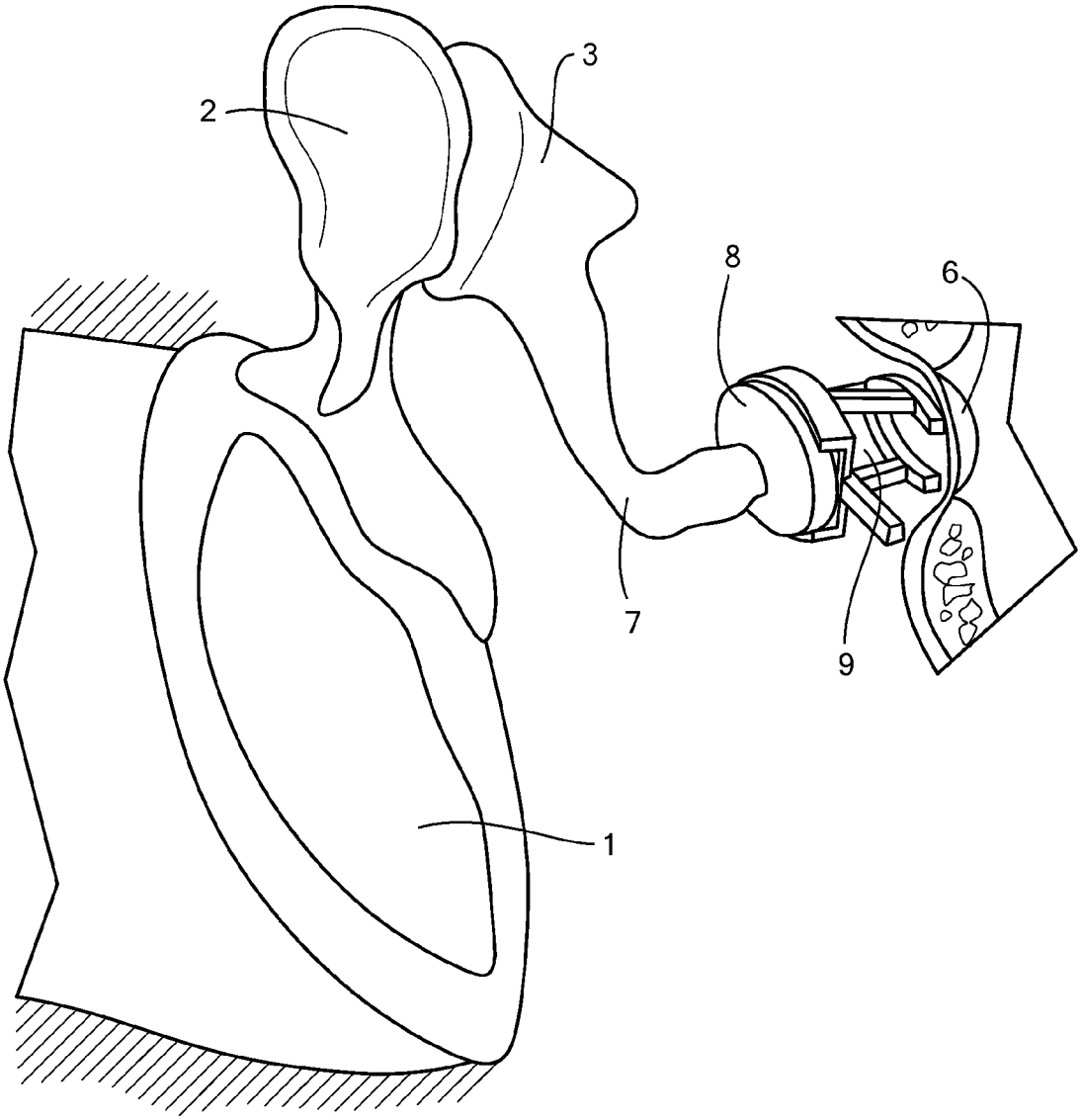
FIG. 1 PRIOR ART
FIG. 1 shows elements of the middle ear with an implanted converter according to the prior art.

In a normal functioning ear, sounds are transmitted through the outer ear to the tympanic membrane (eardrum), which moves the ossicles of the middle ear (malleus, incus, and stapes). The middle ear transmits these vibrations to the oval window of the cochlea or inner ear. The cochlea is filled with cerebrospinal fluid, which moves in response to the vibrations coming from the middle ear via the oval window. In response to the received sounds transmitted by the middle ear, the fluid-filled cochlea functions as a transducer to generate electric pulses which are transmitted to the cochlear nerve and ultimately to the brain. FIG. 1 shows elements of a human ear with a prior art implantable converter. As shown, the implantable converter 8 is positioned between the articular cartilage 7 of the severed malleus-incus joint and the recess of the oval window 6 and held in place with a post 9, which is affixed in the bone channel of the stapes tendon. The oscillations of the ear drum 1 are transmitted from the malleus 2, incus 3 and articular cartilage 7 to a thin shell on the implantable converter 8. This prior art configuration, however, requires additional support structures to hold the implantable converter in place within the middle ear ossicles chain.

Figure 2:
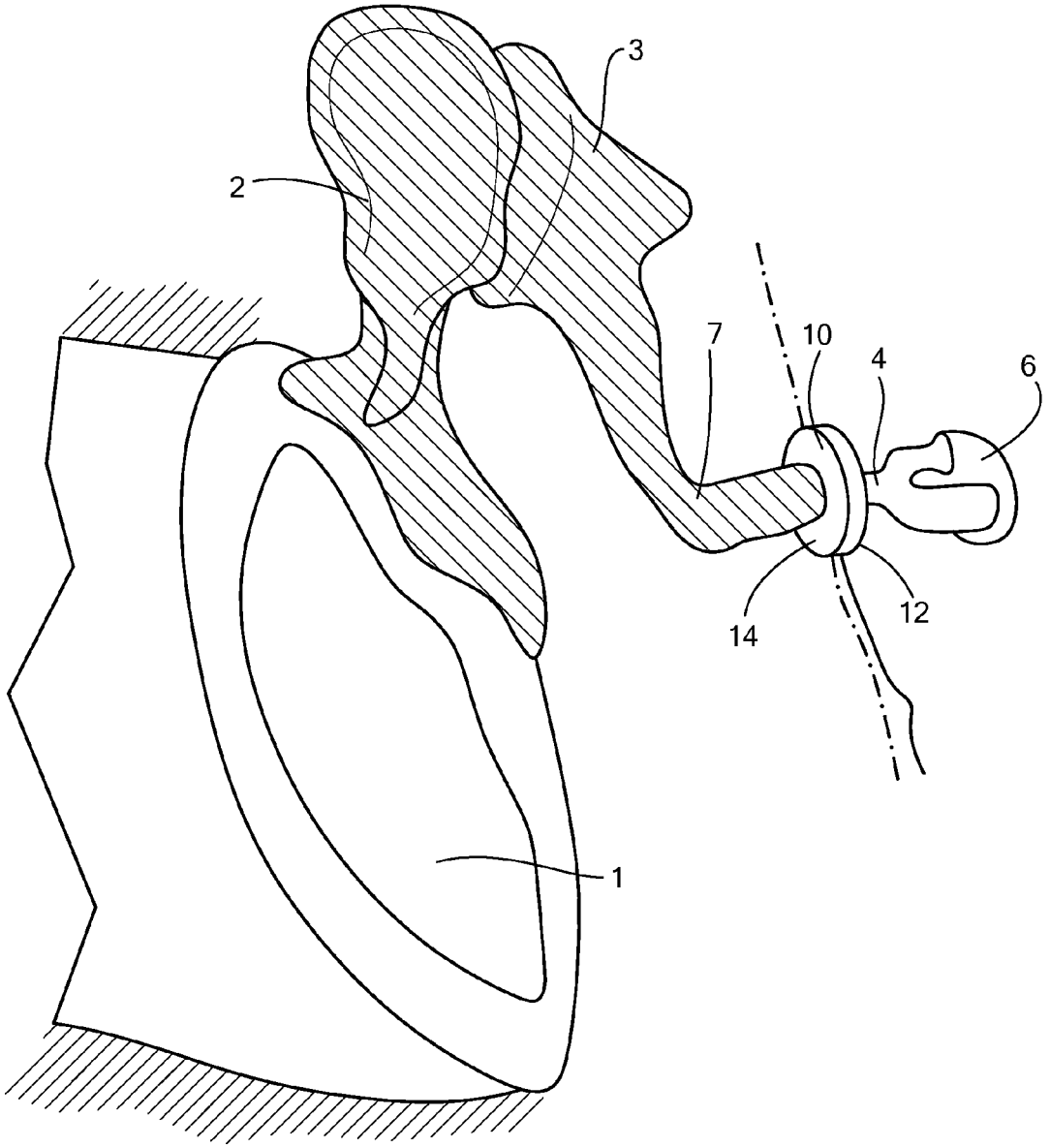
FIG. 2 schematically shows an implantable microphone positioned within the ossicle chain according to embodiments of the present invention.

FIG. 2 shows an implantable microphone according to embodiments of the present invention positioned within the ossicles chain. The microphone 10 may be configured to be inserted between two ossicles, e.g., between the incus 3 and the stapes 4 (as shown in FIG. 2), between the malleus 2 and the stapes 4 (as discussed in further detail below with respect to FIGS. 12 and 13) or between any part of the ossicles. As shown in more detail in FIGS. 3A-3C, the implantable microphone 10 includes a housing 12 having a sidewall 12*c*, and a first membrane 14 coupled to a top portion of the housing 12 and configured to be coupled to an auditory ossicle. The implantable microphone 10 also includes a second membrane 15 coupled to the sidewall 12*c* of the housing 12 and a vibration sensor 16 adjacent to the second membrane 15. The second membrane 15 is configured to move in response to movement from the auditory ossicle. The vibration sensor 16, which may be coupled to the sidewall 12*c* or to the second membrane 15, is configured to measure the movement of the second membrane 15 and convert the measurement into an electrical signal.

Figure 3A:
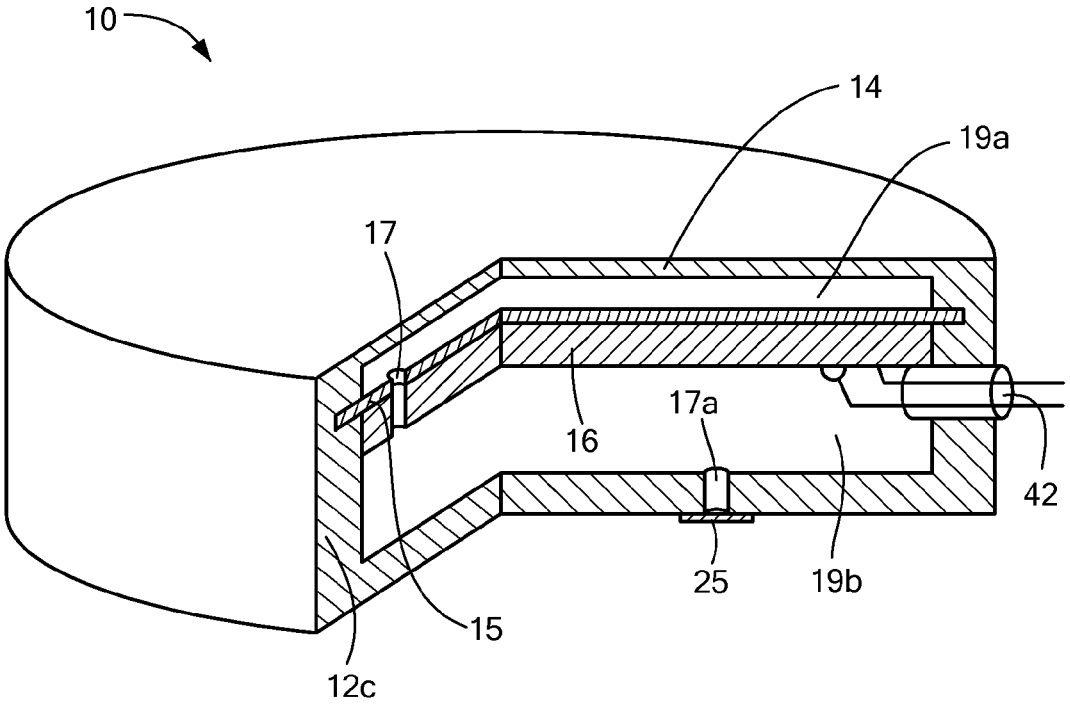
FIGS. 3A through 3C schematically show a perspective view of an implantable microphone with a portion of the microphone removed showing various locations for a venting hole according to embodiments of the present invention.
Figure 3B:
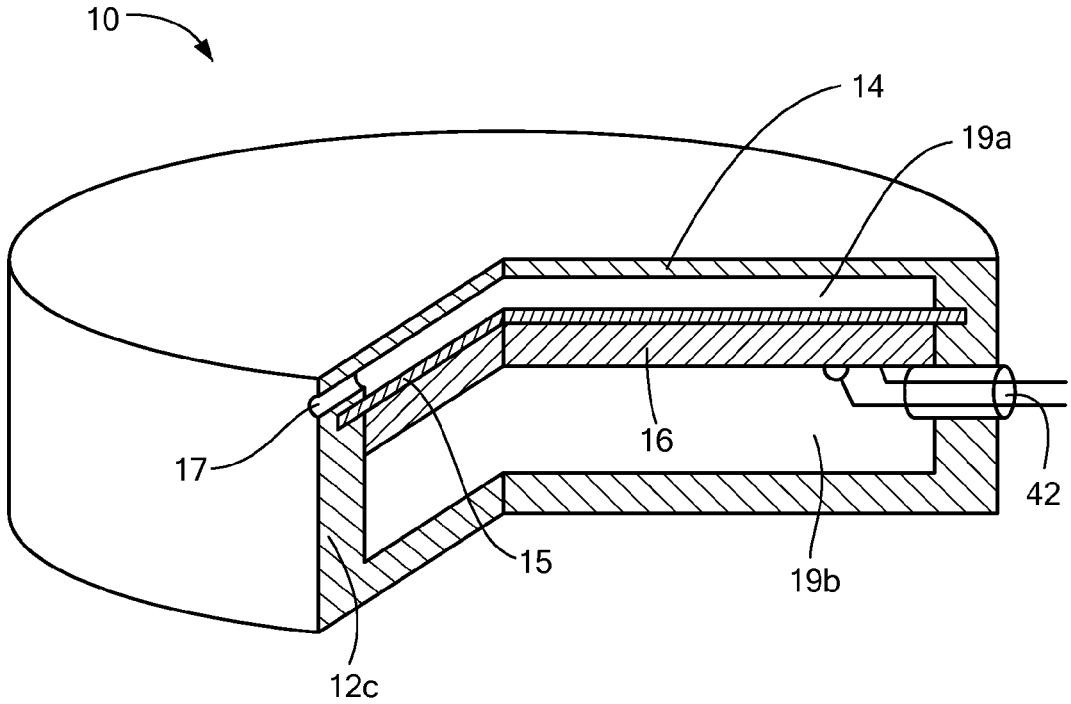
Figure 3C:
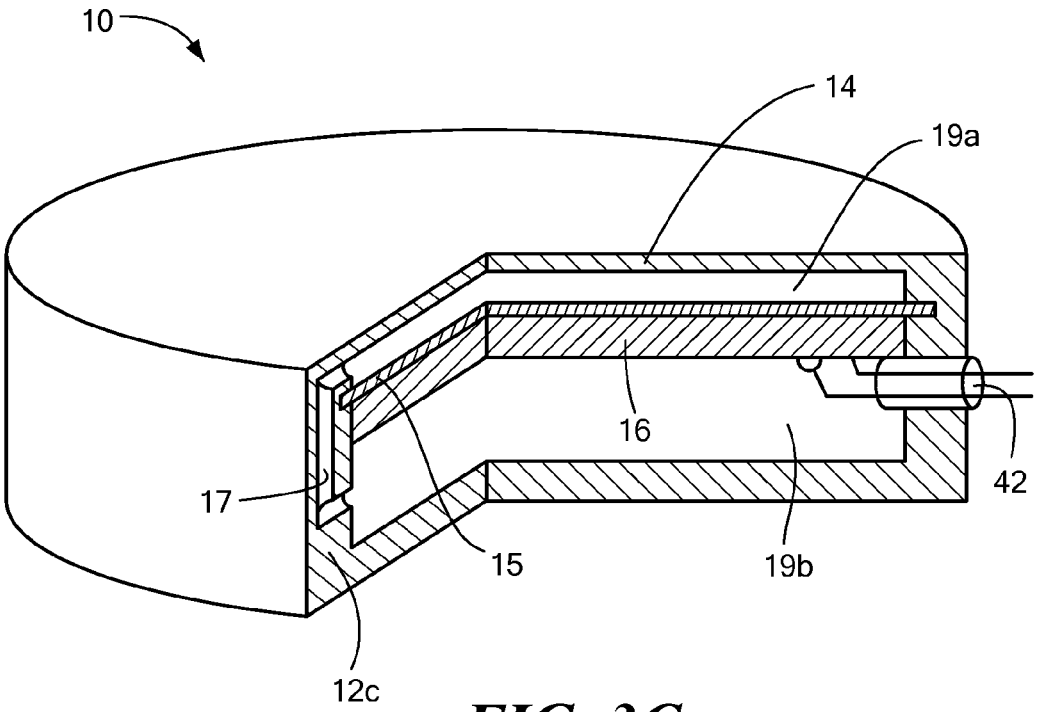

The first membrane 14 may be coupled to the housing 12 in such a way as to provide a hermetically sealed interior volume within the housing 12 where the second membrane 15 and the vibration sensor 16 are provided. The housing 12, the first membrane 14, and the second membrane 15 may be made of any suitable biocompatible material, e.g., material enabling hermetical sealing. In addition, the first and second membrane 14, 15 material should have a certain amount of elasticity. For example, the housing 12, first and second membranes 14, 15 may be made from metal (e.g., niobium, titanium, alloys thereof, etc. with various crystal structures, e.g., mono crystalline silicon, etc.) or any kind of ceramics (e.g., aluminum oxide such as ruby or sapphire) or plastic material (e.g., epoxy, PMMA, etc.). The biocompatible materials may be biocompatible coated materials (e.g., coating material such as parylene, platinum plating, $SiO_2$, etc.). The first and second membranes 14, 15 may be coupled to the housing 12, depending on the respective materials used, by any known technique, e.g. welding (ultrasonic welding, laser welding, etc.), brazing, bonding, etc. Although the housing 12 is shown in FIGS. 3A-3C having a round, cylindrical shape, the housing 12 may have any suitable shape, e.g., cylindrical with an oval or circular cross-sectional shape, rectangular with a square or rectangular cross-sectional shape, a cube, etc., but preferably the shape does not exceed about 6 mm×4 mm×2 mm in size.

The vibration sensor 16 may be coupled to the second membrane 15, depending on the respective materials used, by any known technique, e.g., adhesive, electrically conductive adhesive, etc. Alternatively, or in addition, the vibration sensor 16 may be coupled to the sidewall 12*c*, by any known technique. The vibration sensor 16 may have one end coupled to the sidewall 12*c* and the other end free to move, may have two ends coupled to the sidewall 12*c*, or may have substantially all edges coupled to the sidewall 12*c*. One or more vibration sensors 16 may be used in the implantable microphone 10 and may be coupled to the second membrane 15 and to one another, or coupled to one or more areas in the sidewall 12*c* of the housing 12. The vibration sensors 16 may be coupled to the same side of the sidewall 12*c*, coupled to opposite sides of the sidewall 12*c*, and/or coupled to the sidewall 12 substantially around its interior. Coupling the vibration sensor 16 at one end, e.g., at the sidewall 12*c* of the housing 12, allows the vibration sensor 16 to flex toward its other end in response to movement from the second membrane 15. The benefit of this type of configuration is that a cantilever bar vibration sensor 16 may be used, is driven by the second membrane 15 deflection and acts as a bending spring. Since this configuration of vibration sensor 16 does not follow the second membrane 15 contour, it avoids the counter rotating bending momentums that lead to erroneous compensating charges on the vibration sensor's surface.

In embodiments of the present invention, the second membrane 15 is positioned within the housing 12 such that a volume inside the housing 12 is divided into two volumes 19*a*, 19*b*. The first volume 19*a* is between the first membrane 14 and the second membrane 15, and the second volume 19*b* is between the second membrane 15 and a back wall 12*b* of the housing 12. Preferably, the first volume 19*a* is less than the second volume 19*b*. The first volume 19*a* includes an opening 17 that permits fluid to flow out from the first volume 19*a*. For example, the opening 17 may be in the second membrane 15 (as shown in FIG. 3A) or may be in the sidewall 12*c* of the housing 12 (as shown in FIGS. 3B and 3C). The opening 17 in the sidewall 12*c* may permit the fluid to flow from the first volume 19*a* to an area external to the housing 12 (as shown in FIG. 3B) and/or may permit the fluid to flow from the first volume 19*a* to the second volume 19*b* (as shown in FIG. 3C). In addition, the second volume 19*b* may include a second opening 17*a* in the back wall 12*b* (as shown in FIG. 3A) and/or the sidewall 12*c* (not shown). When the opening(s) 17, 17*a* permit the fluid to flow out of the housing 12 (as shown in FIGS. 3A and 3B), the opening may be covered by a membrane 25. For example, a membrane that is air permeable but is impermeable to humidity or water may be used, e.g., a Gor-Tex or Tyvek membrane. Thus, when the first membrane 14 moves, the volume of the first volume 19*a* changes relative to the volume of the second volume 19*b*, causing fluid to flow from the first volume 19*a* to the second volume 19*b*, from the second volume 19*b* to the first volume 19*a*, from the first volume 19*a* out of the housing 12, or from the first volume 19*a* and the second volume 19*b* out of the housing 12. When fluid flows between the two volumes 19*a*, 19*b*, this configuration enables pressure exchange between these two volumes. The larger the deformations of the first membrane 14, the more fluid flows between the two volumes 19*a*, 19*b*, or out from the first or second volumes 19*a*, 19*b*, which changes the amount of pressure being applied to the second membrane 15 as a result of the motion of the first membrane 14. This configuration allows the second membrane 15 to follow the motion of the first membrane 14 only under certain conditions and potentially prevents the vibration sensor 16, which is adjacent to the second membrane 15, from being subjected to harmful deflections of the first membrane 14. For example, the second membrane 15 may not substantially move or deflect when the first membrane 14 moves in response to low-frequency or static deformations, e.g., deformations due to differences between the static pressure on the inside and outside of the housing cavity which are typically larger than the deformations caused by movement of the ossicles. Thus, the second membrane 15 may be configured to only follow the dynamic deformations of the first membrane 14 above a certain lower border frequency, protecting the vibration sensor 16 from potential harm or deterioration.

The lower border frequency may be varied depending on a variety of design parameters in the implantable microphone 10, e.g., the diameter of the opening 17, the fluid within the volumes 19*a*, 19*b* (e.g., gas or liquid), the shapes and sizes of the volumes 19*a*, 19*b*, and the dimensions and stiffness of both membranes 14, 15. These design parameters may be varied to tune the lower border frequency and transfer characteristics of the dynamic deflection movement of the second membrane 15 in relation to the first membrane 14. Alternatively, instead of an opening 17, a venting channel (not shown) may be implemented that connects the two volumes 19*a*, 19*b*. The diameter and the length of the venting channel may be varied to tune the lower border frequency.

Figure 4A:
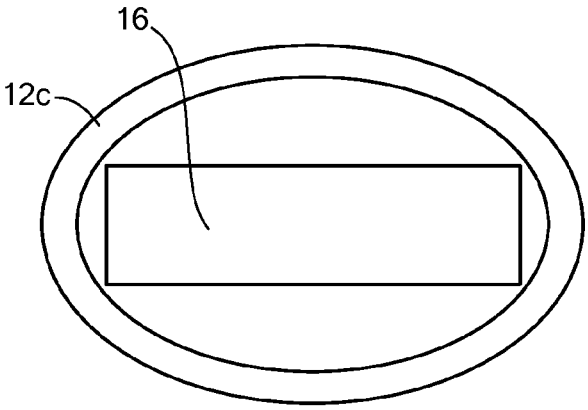
FIGS. 4A and 4B schematically show a top view and perspective view, respectively, of an implantable microphone with some areas removed showing a vibration sensor according to embodiments of the present invention.
Figure 4B:
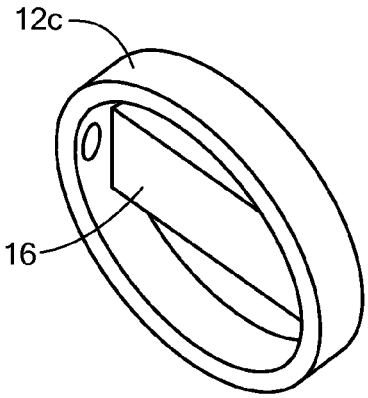

In order to achieve maximum sensitivity and signal-to-noise ratio, the vibration sensor 16 may be a piezoelectric sensor. The piezoelectric sensor may include one or more piezoelectric sensor elements, e.g., formed of a piezoelectric material such as a single crystal material. Piezoelectric materials may include piezoelectric crystal materials, piezoelectric ceramic materials, piezoelectric polymer foam or foil structures (e.g., polypropylene) that include electroactive polymers (EAPs), such as dielectric EAPs, ionic EAPs (e.g., conductive polymers, ionic polymer-metal composites (IPMCs)), and responsive gels such as polyelectrolyte material having an ionic liquid sandwiched between two electrode layers, or having a gel of ionic liquid containing single-wall carbon nanotubes, etc, although other suitable piezoelectric materials may be used. As shown in FIGS. 4A and 4B, the piezoelectric sensor may be in the shape of a thin, rectangular bar or may be in the shape of a circular plate, a square plate, etc. (not shown) depending on the shape of the housing 12 used, although other shapes may also be used.

As mentioned above, the vibration sensor 16 measures the movement of the second membrane 15 and converts the measurement into an electrical signal. For example, a piezoelectric sensor having one or more sensor elements may include electrodes on either side of the sensor elements. The movement of the piezoelectric sensor causes deformation of the piezoelectric material, which in turn evokes voltage and charge transfer on the electrodes of the sensor 16, thus providing a voltage or charge measurement signal. The sensor elements may be formed by a stack of piezoelectric foils or by folded piezoelectric foils. The folding or stacking may help to increase voltage or charge yield.

Figure 5:
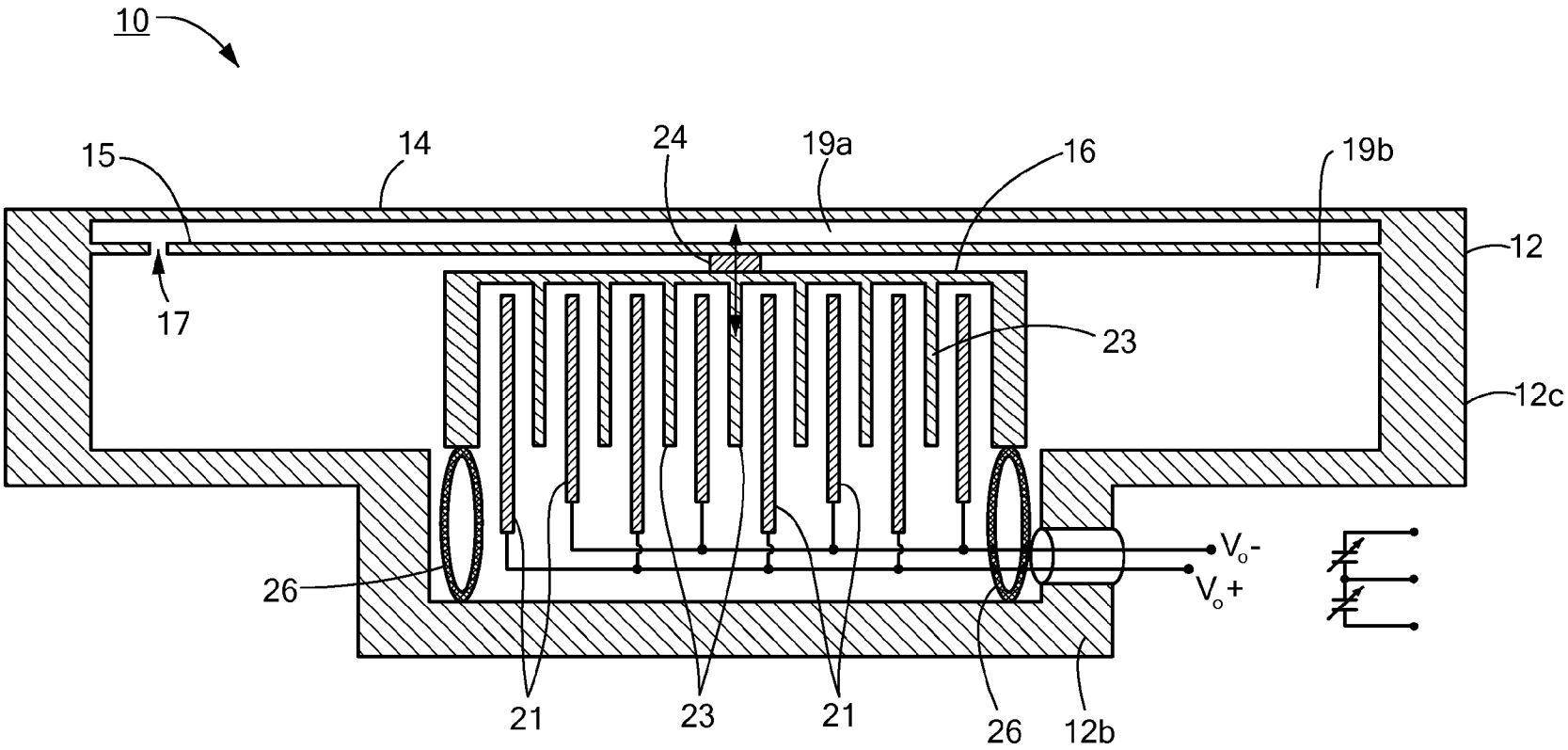
FIG. 5 schematically shows a cross-sectional view of an implantable microphone with a MEMS sensor according to embodiments of the present invention.
Figure 6:
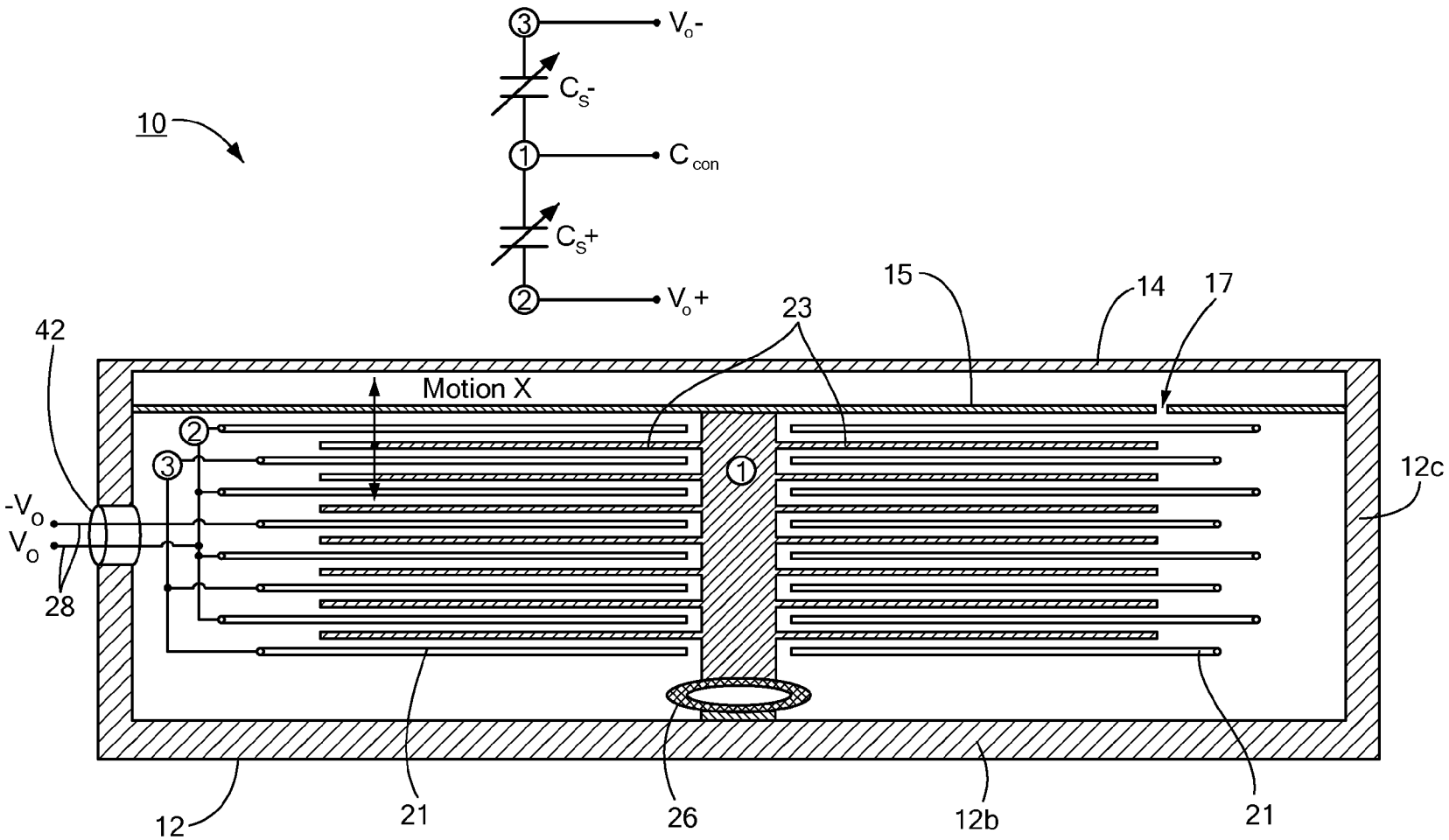
FIG. 6 schematically shows a cross-sectional view of an implantable microphone with another configuration of a MEMS sensor according to embodiments of the present invention.

In another embodiment, the vibration sensor 16 may be a microelectromechanical system (MEMS) sensor, such as a MEMS differential capacitor, as shown in FIGS. 5 and 6. As known by those skilled in the art, a MEMS differential capacitor typically includes a movable, inertial mass coupled to one or more movable structures or fingers and includes one or more fixed, non-moving structures or fingers. The movement of the movable fingers or plates in relation to the fixed fingers or plates causes a change in capacitance that may be measured. Thus, in the present embodiment, the MEMS differential capacitor may have one part 21 of a structure that is coupled to the housing 12 and another part 23 of the structure that is movable in relation to the fixed part 21 and that is coupled to the second membrane 15. The MEMS differential capacitor may be coupled to the second membrane 15, such as shown in FIG. 6, or may be coupled to the second membrane 15 by a coupling element 24 positioned between the second membrane 15 and the MEMS sensor, such as shown in FIG. 5. Preferably, the coupling of the MEMS sensor to the second membrane 15 is near the center of the second membrane 15, since the MEMS sensor is typically driven in one dimension and is not designed to follow the second membrane 15 bending line. As the second membrane 15 moves, the movable portion 23 moves relative to the fixed portion 21, and the change in capacitance between the fixed portion 21 and the movable portion 23 is read out and converted into a microphone signal. The microphone signal may be processed through a signal conditioning circuit as known by those skilled in the art. Although the above discussion describes the MEMS sensor coupled to the second membrane 15, embodiments may also include an implantable microphone without a second membrane 15. In this case, the MEMS sensor is coupled to the first membrane 14 with or without a coupling element 24.

When the vibration sensor 16 is coupled to the sidewall 12*c*, an element (not shown) may be placed between the vibration sensor 16 and the second membrane 15. When one or more vibration sensors 16 are used, one or more elements may be placed between the second membrane 15 and the vibration sensor 16 or between each of the vibration sensors 16. The element(s) may assist in keeping the vibration sensors 16 in contact with each other and with the second membrane 15 so that the movement of the vibration sensors 16 correlates to the second membrane 15 motion. The elements may be on both sides of the vibration sensor 16 or on one side of the vibration sensor 16, preferably toward its middle. One or more vibration sensors 16 may substantially span the interior of the housing 12. Alternatively, or in addition, one or more vibration sensors 16 may span only a portion of the interior of the housing 12.

The vibration sensors 16 may be configured as a stack of vibration sensors 16. The multilayer stack may include, for example, alternating layers of piezoelectric material and conductive material, each layer as thin as possible. The multilayer stack may be configured as parallel capacitors for maximum charge yield or may be configured as serial capacitors for maximum voltage yield.

The implantable microphone 10 may further include one or more spring elements 26 positioned between the one or more vibration sensors 16 and the housing 12. For example, the spring elements 26 may be positioned between the housing 12 and the movable portion 23 of the structure in the MEMS sensor. The one or more spring elements 26 may assist in keeping the one or more vibration sensors 16 in contact with each other and the second membrane 15 so that the movement of the vibration sensor(s) 16 correlates to the second membrane 15 motion. For example, membrane motion may include flexural motion which may entail bending, compression and/or shear deformation of the second membrane 15. The vibration sensor(s) 16, driven by the second membrane 15 movement, may thus also undergo flexural motion (e.g., bending, compression and/or shear deformation of the sensor) in a manner that correlates to the movement of the second membrane 15. In addition, the one or more spring elements 26 may assist in restoring the vibration sensor 16 to its original position.

The housing 12 may include a groove (not shown) in a back wall 12*b* on the interior of the housing 12 for the spring element 26 to fit within. The spring element 26 and groove may be located on either side of the housing 12, such as shown in FIG. 5, or towards the middle of the housing, such as shown in FIG. 6, depending on the position of the spring element 26 in relation to the vibration sensor 16.

Referring again to FIGS. 3A-3C, the implantable microphone 10 also includes one or more feedthroughs 42 (e.g., hermetically sealed electrically insulated feedthroughs) and one or more leads 28 providing an electrical coupling to the vibration sensors 16. The leads 28 may be electrically coupled to the vibration sensor 16 and lead out of the housing 12 through the feedthrough 42. The feedthroughs 42 may be placed through the sidewall 12*c* of the housing 12 so that the electrical signal from the vibration sensor 16 may be carried by the leads 28 from the interior area to outside of the housing 12. As known by those skilled in the art, the signal leads 28 and cables may be made of any kind of electrically conductive material, e.g., metals such as copper, gold, aluminium, etc. and alloys thereof, conductive polymers such as polyethylene sulphide, poly(acetylene)s, poly(pyrrole)s, poly(thiophene)s, polyanilines, polythiophenes, poly (p-phenylene sulfide), and poly(para-phenylene vinylene)s (PPV) coated with an insolating film of material such as parylene, epoxy, silicone, etc., or combinations thereof. The leads 28 may be designed as flexible printed circuit boards, which may be based on thin film technology. The leads 28 are configured to transfer an electrical signal from the sensor 16 to an implantable device, such as a cochlear implant. Preferably, the leads 28 are designed as flexible as possible to avoid restoring and/or damping forces that may cause losses in the detected motion of the middle ear components.

Figure 7:
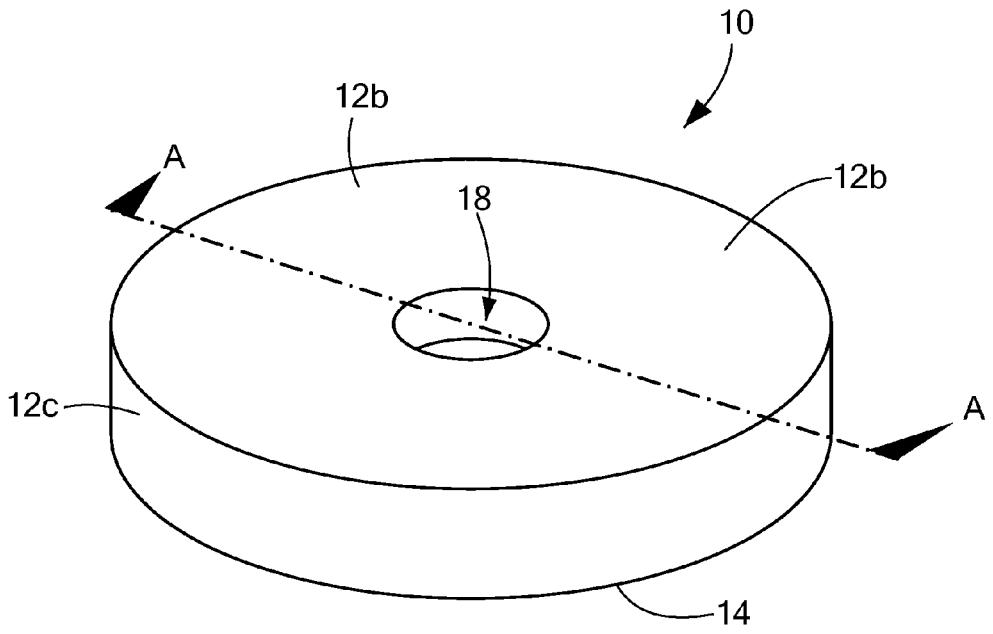
FIG. 7 schematically shows a perspective view of an implantable microphone with a recess in a back wall according to embodiments of the present invention.
Figure 8:
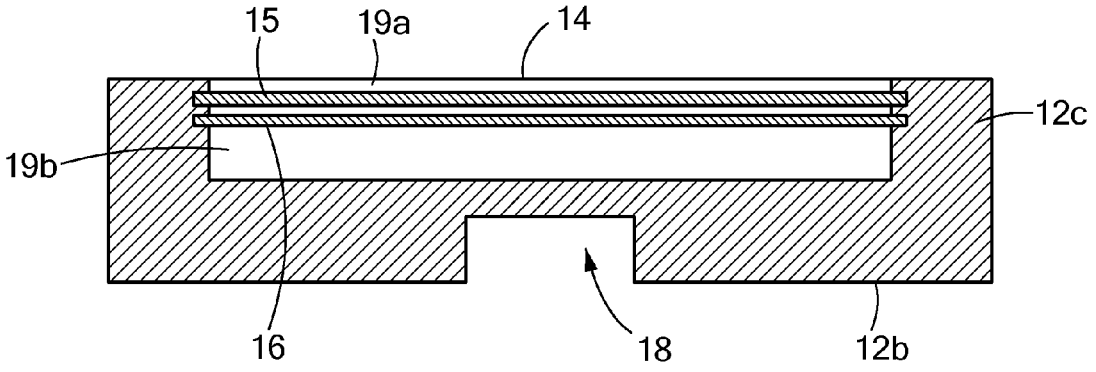
FIG. 8 schematically shows a cross-sectional view of an implantable microphone along line A-A of FIG. 7 according to embodiments of the present invention.

In some embodiments, a back wall 12*b* of the housing 12 may have a recess 18 (e.g., blind hole) configured to be coupled to an auditory ossicle, as shown in FIGS. 7 and 8. Preferably, the recess 18 is substantially aligned with a center of the first and second membranes 14, 15 such as shown in FIG. 8. This allows the placement of the microphone 10 to be optimized on the auditory ossicle, increasing the sensitivity of the microphone 10. In addition, the first membrane 14 may further include a structure (not shown) substantially positioned at the center of the first membrane 14 to optimize the placement of the microphone 10 on the auditory ossicle. The structure may be etched into the first membrane 14, deposited onto the first membrane 14 or mounted onto the first membrane 14.

Figure 10:
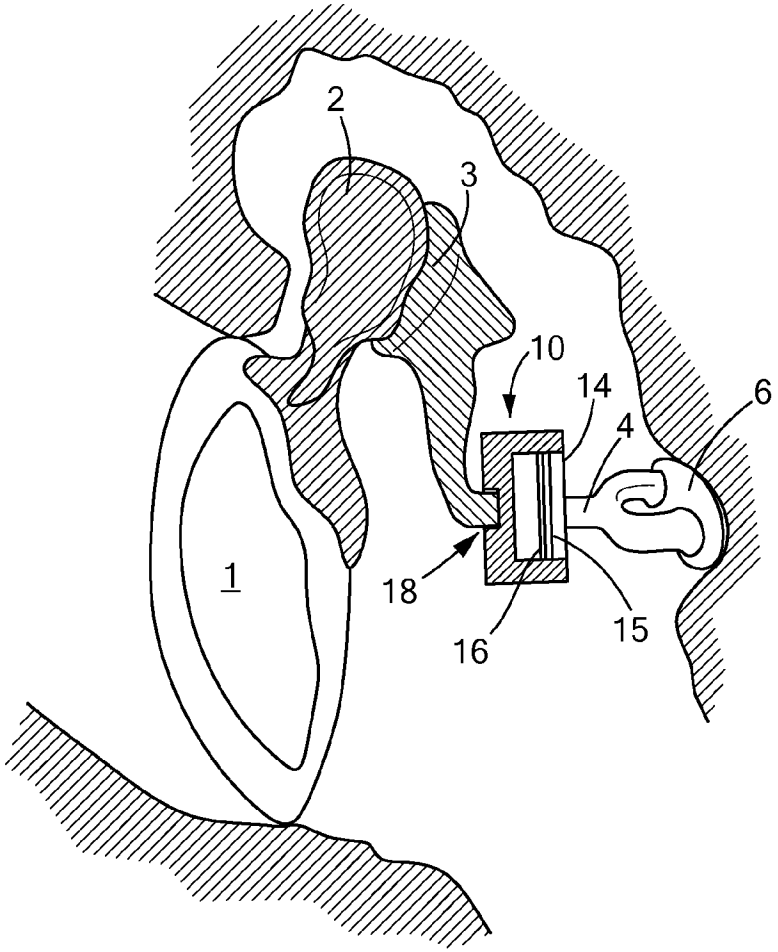
FIG. 10 schematically shows an implantable microphone positioned in another orientation within the ossicle chain according to embodiments of the present invention.
Figure 9:
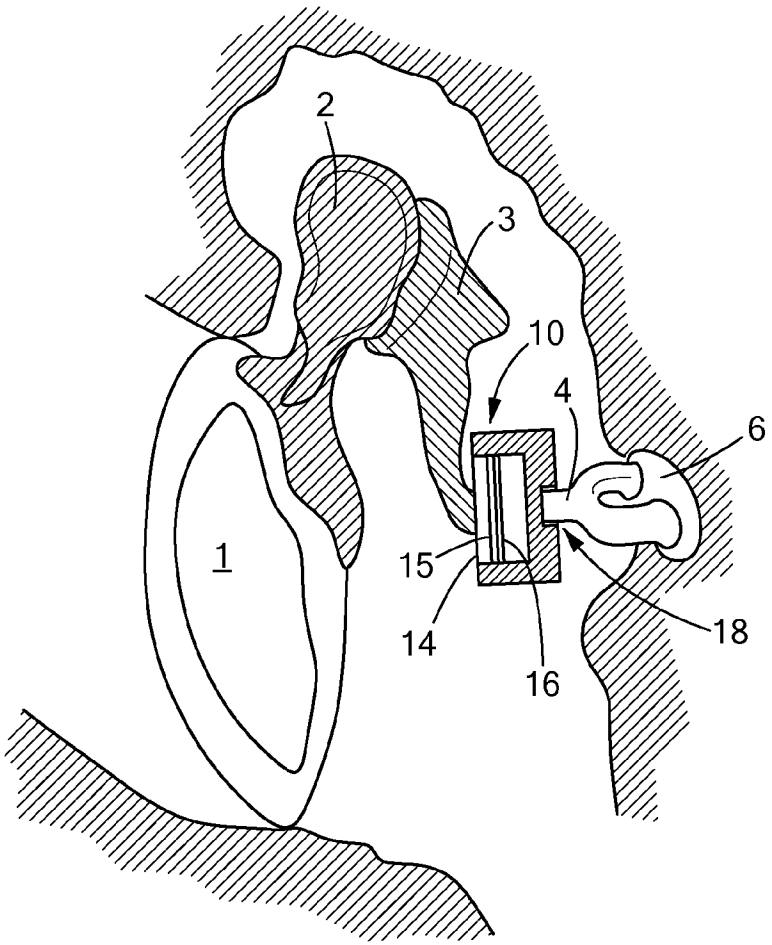
FIG. 9 schematically shows an implantable microphone positioned in one orientation within the ossicle chain according to embodiments of the present invention.

FIGS. 9 and 10 schematically show an implantable microphone 10 positioned in different orientations within the ossicles chain. As shown in FIG. 9, the back wall 12*b* of the housing 12 may be facing towards the stapes 4 or oval window 6 and the first and second membranes 14, 15 may be facing towards the incus 3 or the ear drum 1. In this embodiment, the recess 18 in the back wall 12*b* allows the implantable microphone 10 to be held in position on a portion of the stapes 4. If an additional structure is provided on the first membrane 14, the structure further allows the implantable microphone 10 to be held in position on a portion of the incus 3. Alternatively, as shown in FIG. 10, the back wall 12*b* of the housing 12 may be facing towards the incus 3 or the ear drum 1 and the first and second membranes 14, 15 may be facing towards the stapes 4 or oval window 6. In this embodiment, the recess 18 in the back wall 12*b* allows the implantable microphone 10 to be held in position on a portion of the incus 3. If an additional structure is provided on the first membrane 14, the structure further allows the implantable microphone 10 to be held in position on a portion of the stapes 4. Centering the first and second membranes 14, 15 on the auditory ossicle improves the sensitivity of the microphone 10. Thus, embodiments of the present invention permit the orientation of the microphone 10 to be varied depending on a patient's anatomical or surgical requirements. Although not shown, one or more spring elements may be used with the implantable microphone 10 in order to further secure the microphone 10 within the ossicle chain. The spring element(s) may be coupled to a portion of the implantable microphone 10 and act as a flexible support member between the implantable microphone 10 and one or more components of the ossicle chain. For example, the flexible support member may be anchored in the eminentia pyramidalis (triangle of tendons and muscles within the tympanum 1) since this area is capable of anchoring an interface cable that may lead to the implantable microphone 10.

Figure 12:
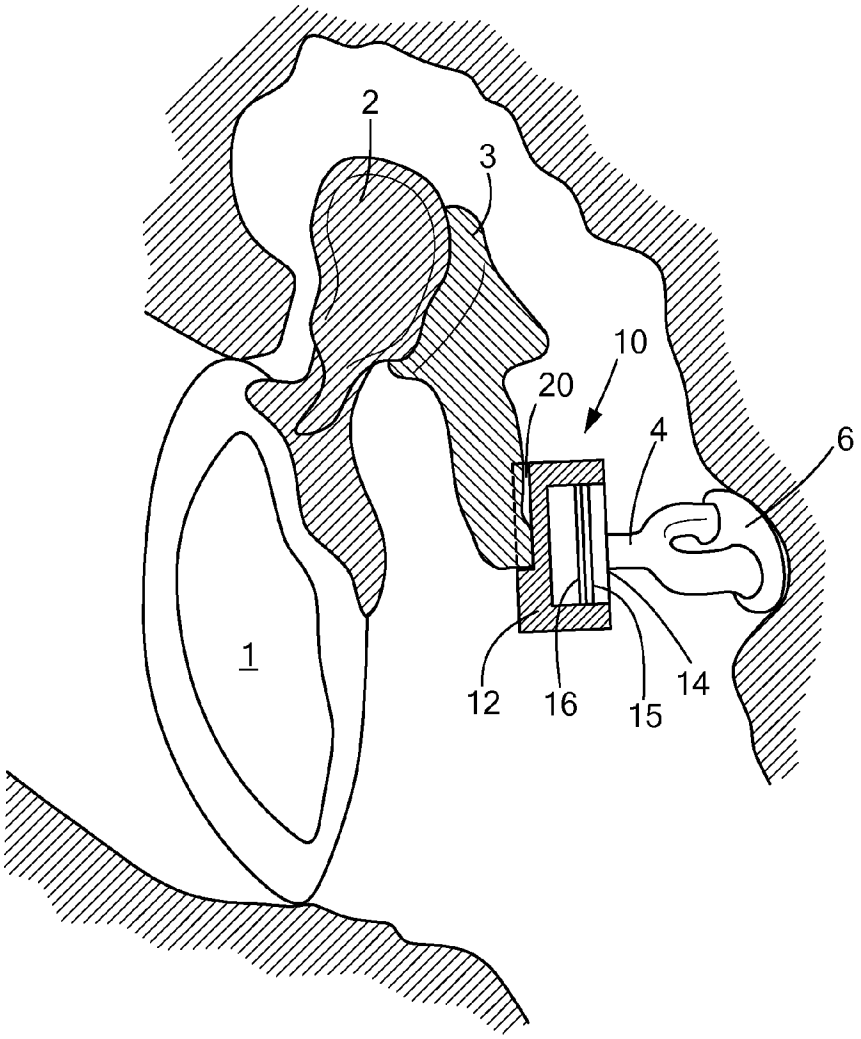
FIG. 12 schematically shows an implantable microphone having a recess that includes a channel positioned within the ossicle chain according to embodiments of the present invention.
Figure 11:
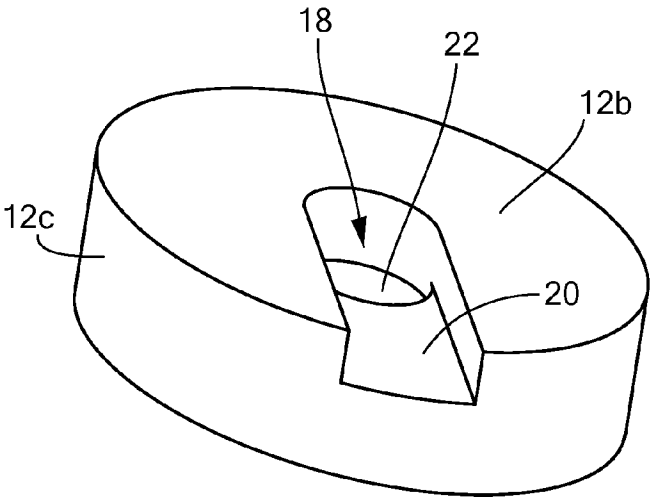
FIG. 11 schematically shows a perspective view of an implantable microphone having a recess in the housing that includes a channel according to embodiments of the present invention.

FIG. 11 schematically shows a perspective view of an implantable microphone 10 having a recess 18 in the housing 12 that includes a channel 20 extending from a center of the back wall 12*b* to at least one sidewall 12*c* of the housing 12. The recess 18 may include a further recessed area 22 at the center of the back wall 12*b*. The channel 20 and recessed area 22 may allow the implantable microphone 10 to be further positioned and secured onto the auditory ossicles, such as shown in FIG. 12. The channel 20 may reduce any lateral movement of the microphone 10 once it is placed onto a portion of the stapes 4 or the incus 3. After fixation of the housing 12, the channel 20 may be placed parallel to the incus 3 thus avoiding space conflicts between the incus 3 and the housing 12.

Figure 14:
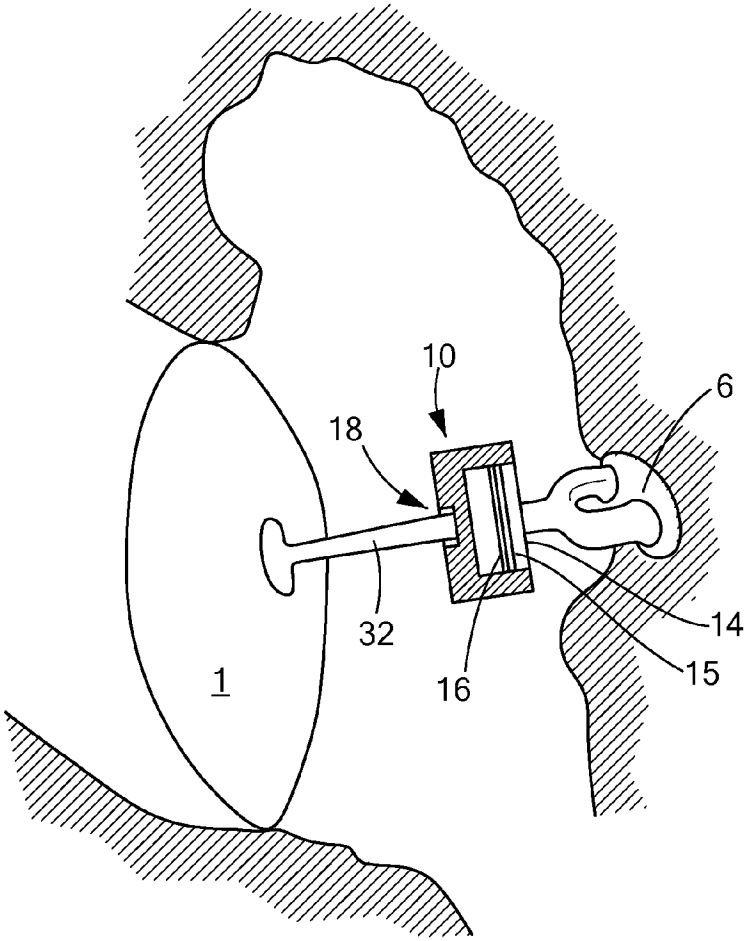
FIG. 14 schematically shows an implantable microphone coupled to the tympanic membrane in another orientation according to embodiments of the present invention.
Figure 13:
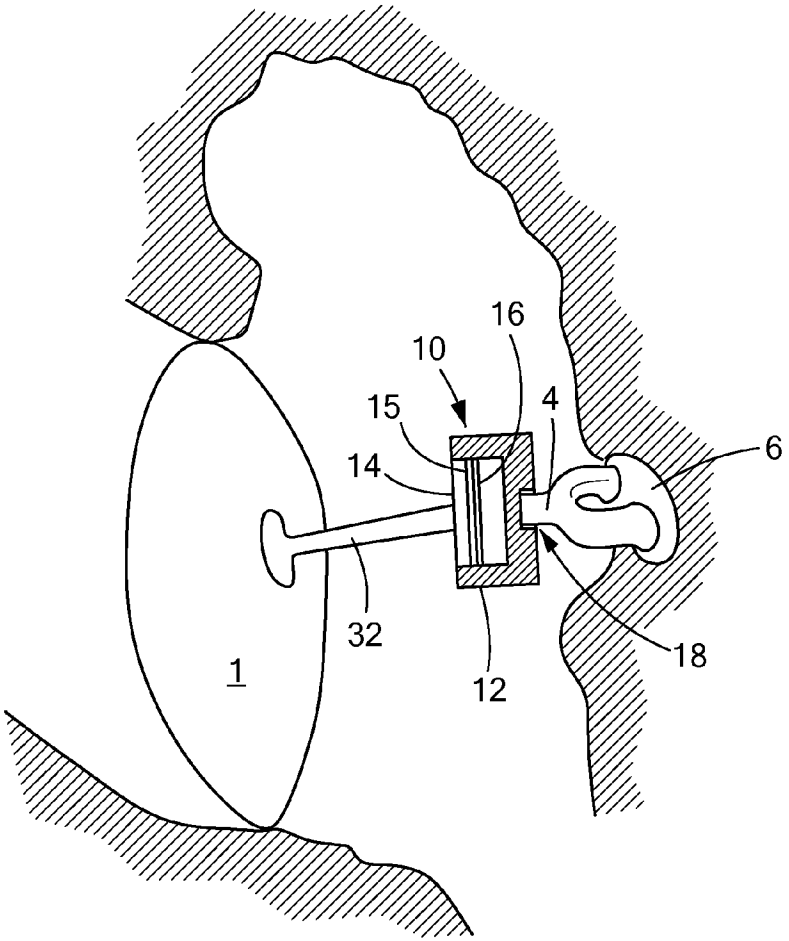
FIG. 13 schematically shows an implantable microphone coupled to the tympanic membrane in one orientation according to embodiments of the present invention.

Although the implantable microphone 10 was shown in FIGS. 2, 9, 10 and 12 positioned between the incus 3 and the stapes 4, the implantable microphone 10 may be used in other configurations. For example, as shown in FIGS. 13 and 14, the implantable microphone 10 may be positioned between the stapes 4 (or oval window 6) and ear drum 1 with an additional piece of a stapes prosthesis 32.

Although the above discussion discloses various exemplary embodiments of the invention, it should be apparent that those skilled in the art may make various modifications that will achieve some of the advantages of the invention without departing from the true scope of the invention.

What is claimed is:

1. An implantable microphone for use in hearing systems comprising:

a housing having a sidewall;

a first membrane coupled to a top portion of the housing, the first membrane configured to move in response to movement from an auditory ossicle;

a second membrane coupled to the sidewall and configured to move in response to movement from the first membrane, the second membrane dividing an interior volume of the housing into a first volume and a second volume such that the first volume is on one side of the second membrane and the second volume is on the other side of the second membrane, the first volume having an opening that permits fluid to flow out from the first volume; and a vibration sensor coupled to the second membrane, the vibration sensor configured to measure the movement of the second membrane and convert the measurement into an electrical signal.

2. The implantable microphone according to claim 1, wherein the vibration sensor is coupled to the sidewall.

3. The implantable microphone according to claim 1, wherein the vibration sensor is a piezoelectric sensor.

4. The implantable microphone according to claim 1, wherein the housing further includes a back wall adjacent to the sidewall, wherein the second volume includes a second opening in the back wall or the sidewall.

5. The implantable microphone according to claim 1, wherein the vibration sensor is a MEMS differential capacitor.

6. The implantable microphone according to claim 1, wherein the vibration sensor is coupled to the second membrane with a coupling element positioned between the vibration sensor and the second membrane, the coupling element configured to move the vibration sensor in response to movement from the second membrane.

7. The implantable microphone according to claim 1, wherein the housing further includes a back wall adjacent to the sidewall, and the implantable microphone further includes a spring element coupled to the vibration sensor, the spring element configured to contact the back wall.

8. The implantable microphone according to claim 1, further comprising one or more additional vibration sensors adjacent to the vibration sensor, the one or more additional vibration sensors coupled to the sidewall.

9. The implantable microphone according to claim 8, further comprising a spring element coupled to the one or more additional vibration sensors, the spring element configured to contact the housing and to assist in keeping the one or more vibration sensors in contact with each other and the second membrane.

10. The implantable microphone according to claim 1, further comprising one or more additional vibration sensors adjacent to the vibration sensor, wherein at least one of the additional vibration sensors is coupled to the vibration sensor.

11. The implantable microphone according to claim 1, wherein the vibration sensor includes a stack of vibration sensors.

12. The implantable microphone according to claim 1, wherein the first volume is less than the second volume.

13. A cochlear implant system comprising an implantable microphone according to claim 1.

14. The implantable microphone according to claim 1, wherein the opening is in the sidewall.

15. The implantable microphone according to claim 14, wherein the opening permits fluid to flow from the first volume to the second volume.

16. The implantable microphone according to claim 14, wherein the opening permits fluid to flow from the first volume to an area external to the housing.

17. The implantable microphone according to claim 1, wherein the housing further includes a back wall adjacent to the sidewall, the back wall having a recess configured to be coupled to the auditory ossicle.

18. The implantable microphone according to claim 17, wherein the recess includes a channel extending to the sidewall.

19. The implantable microphone according to claim 17, wherein the recess is substantially aligned with a center of the first membrane.

20. An implantable microphone for use in hearing systems comprising:

a housing having a sidewall and a back wall adjacent to the sidewall, the back wall having a recess configured to be coupled to an auditory ossicle;

a first membrane coupled to a top portion of the housing, the first membrane configured to move in response to movement from the auditory ossicle;

a second membrane coupled to the sidewall and configured to move in response to movement from the first membrane, the second membrane dividing an interior volume of the housing into a first volume and a second volume such that the first volume is on one side of the second membrane and the second volume is on the other side of the second membrane, the first volume having an opening that permits fluid to flow out from the first volume, the second membrane configured to move in response to movement from the fluid; and a vibration sensor coupled to the second membrane, the vibration sensor configured to measure the movement of the second membrane and convert the measurement into an electrical signal, wherein the vibration sensor is a MEMS differential capacitor.

21. The implantable microphone according to claim 20, wherein the vibration sensor is coupled to the second membrane with a coupling element between the second membrane and the vibration sensor, the coupling element configured to assist in keeping the vibration sensor in contact with the second membrane.

22. The implantable microphone according to claim 20, wherein the coupling element is substantially aligned with a center of the second membrane.

23. The implantable microphone according to claim 20, wherein the second volume includes a second opening in the back wall, the sidewall, or both.

24. A cochlear implant system comprising an implantable microphone according to claim 20.

25. The implantable microphone according to claim 20, wherein the opening is in the sidewall.

26. The implantable microphone according to claim 25, wherein the opening permits fluid to flow from the first volume to the second volume.

27. The implantable microphone according to claim 25, wherein the opening permits fluid to flow from the first volume to an area external to the housing.

* * * * *